US008887987B2

(12) United States Patent
Yee et al.

(10) Patent No.: US 8,887,987 B2
(45) Date of Patent: Nov. 18, 2014

(54) FEDERATED VOTING WITH CRITERIA-BASED DISCRIMINATION

(75) Inventors: Dawson Yee, Bellevue, WA (US); Scott C Forbes, Redmond, WA (US); Shai Guday, Redmond, WA (US); Miller Thomas Abel, Mercer Island, WA (US)

(73) Assignee: Microsoft Corporation, Redmond, WA (US)

( * ) Notice: Subject to any disclaimer, the term of this patent is extended or adjusted under 35 U.S.C. 154(b) by 1916 days.

(21) Appl. No.: 11/550,274

(22) Filed: Oct. 17, 2006

(65) Prior Publication Data

US 2008/0087729 A1 Apr. 17, 2008

(51) Int. Cl.
*G07C 13/00* (2006.01)

(52) U.S. Cl.
CPC ..... *G07C 13/00* (2013.01)
USPC ..... 235/51

(58) Field of Classification Search
CPC ..... G07C 13/00; G07C 13/02; B42D 15/00
USPC ..... 235/50 A, 51
See application file for complete search history.

(56) References Cited

U.S. PATENT DOCUMENTS

| | | | | |
|---|---|---|---|---|
| 6,578,008 | B1 | 6/2003 | Chacker | |
| 6,662,998 | B2 | 12/2003 | McClure et al. | |
| 7,377,430 | B2 * | 5/2008 | Fleischman | 235/386 |
| 2002/0038236 | A1 | 3/2002 | Schechter et al. | |
| 2003/0100321 | A1 | 5/2003 | Rao et al. | |
| 2003/0172004 | A1 | 9/2003 | Anderson | |
| 2003/0182177 | A1 | 9/2003 | Gallagher et al. | |
| 2003/0189592 | A1 | 10/2003 | Boresjo | |
| 2003/0196198 | A1 | 10/2003 | Broussard et al. | |
| 2003/0211856 | A1 | 11/2003 | Zilliacus | |
| 2004/0235460 | A1 | 11/2004 | Engstrom et al. | |
| 2005/0120389 | A1 * | 6/2005 | Boss et al. | 725/135 |
| 2005/0197144 | A1 * | 9/2005 | Tam et al. | 455/466 |
| 2005/0273804 | A1 | 12/2005 | Preisman | |
| 2005/0289038 | A1 | 12/2005 | Karapetian | |

FOREIGN PATENT DOCUMENTS

| | | | | |
|---|---|---|---|---|
| GB | 2376101 | A1 | 12/2002 | |
| WO | WO 01/20431 | A2 * | 3/2001 | G06F 1/00 |

OTHER PUBLICATIONS

Glover, "SMS/Text Voting Solution for MS Smartphone released," Date: Sep. 16, 2005, http://msmobiles.com/news.php/4287.html.

Rantanen, et al., "InfoRadar: Group and Public Messaging in the Mobile Context," Date: 2004, p. 131-140, Publisher: ACM Press, New York, USA, http://delivery.acm.org/10.1145/1030000/1028035/p131-rantanen.pdf?key1=1028035&key2=0683115511&coll=GUIDE&dl=GUIDE&CFID=1040190&CFTOKEN=99353099.

Brad Templeton; Brad Ideas; The Real Location Aware Service; Submitted by Brad on Sat, Jan. 3, 2004; Brad's Blog.

(Continued)

*Primary Examiner* — Rafferty Kelly
(74) *Attorney, Agent, or Firm* — Dan Choi; Judy Yee; Micky Minhas

(57) ABSTRACT

Technology for use with computing devices, particularly mobile devices and wireless networks supporting federation, enabling people, devices, systems, or the like to join together in electronic federations for purposes of voting or the like. The votes in such voting situations may be weighted based on various criteria associated with the voter, the subject of the vote, and/or other criteria relevant to the voting scenario. The technology also enables users to monitor a voting scenario in real-time and tailor their own voting or decisions or the like to the scenario, even as it unfolds.

20 Claims, 6 Drawing Sheets

(56) References Cited

OTHER PUBLICATIONS

Dr. Pragnesh Jay Modi; Research; Drexel University, Philadelphia, PA; retrived Oct. 17, 2006.

Maxim Peysakhov, Christopher Dugan, Pragnesh Jay Modi, William Regli; Quorum Sensing on Mobile Ad-Hoc Networks; Department of Computer Science; Drexel University, Philadelphia, PA 19104; Copyright 2006 ACM.

Joan Morris DiMicco; Voting for Group Decisions; Abstract; Apr. 2002 http://web.media.mit.edu/~joanie/voting/.

Matti Rantanen, Antti Oulavsvirta, Jan Blom, Sauli Tiitta, Martti Mantyla; InfoRadar: Group and Public Messaging in the Mobile Context; Helsinki Institute for Information Technology and Nokia Research Center; Finland; Abstract; Copyright 2004 ACM.

"inVoteTM," http://www.mtank.com/NewWebsite/app_invote.htm, downloaded Aug. 11, 2006.

Hill, "Towards National-Scale SMS Voting," http://www.telsis.com/download/I590-1078-01.pdf, TV Loves Mobile 2004, Jun. 25, 2004.

Zhaoyu Liu, Selected Publications, http://coitweb.uncc.edu/~ahliulResearchipublications.html, downloaded Aug. 14, 2006.

Liu, Joy, Thompson; "A Dynamic Trust Model for Mobile Ad Hoc Networks", Proc. 10th IEEE Intl Workshop on Future Trends of Distributed Computing Systems, May 26-28, 2004.

JM DiMicco, "Mobile Ad-hoc Voting," Workshop on Mobile Ad-hoc Collaboration, Conference on Human Factors in Computing Systems (CHI 2002), Minneapolis, MN, Apr. 2002.

* cited by examiner

FEDERATED VOTING WITH CRITERIA-BASED DISCRIMINATION

BACKGROUND

Gathering customer preference information has long been a costly and tedious task demanding surveys, distribution, collection, tabulation, etc., thus making it difficult for an organization to stay abreast of their customer's desires. Even more difficult may be weighting customer preference information based on how various customers fit certain criteria important to the organization. Similarly, consumers may find it difficult to learn how others have rated products or services that they may be interested in, or to determine how they "fit in" to a group or population they may be in or desire to associate with.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The advent of computing environments, particularly mobile devices and wireless networks supporting federation, make it feasible for people to join together in electronic federations for purposes of voting. The votes in such voting situations may be weighted based on various criteria associated with the voter, the subject of the vote, and/or some other data relevant to the voting scenario. Such environments also make it feasible for users to monitor a voting scenario in real-time and tailor their own voting or decisions or the like to the scenario, even as it unfolds.

The present invention provides, among other things, technology and methods for federated voting with criteria-based discrimination as well as real-time voter monitoring of voting scenarios.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided herein below in connection with the appended drawings is intended as a description of the present examples and is not intended to represent the only forms in which the present invention may be constructed or utilized. The description sets forth functions of the examples and sequences of steps for constructing and operating examples. However, the same or equivalent functions and sequences may be accomplished by different examples.

Although the present examples are described and illustrated herein as being implemented in a computing and networking environment, the environments and systems described are provided as examples and not limitations. As those skilled in the art will appreciate, the present examples are suitable for application in a variety of different types of environments and systems.

Figure 1:
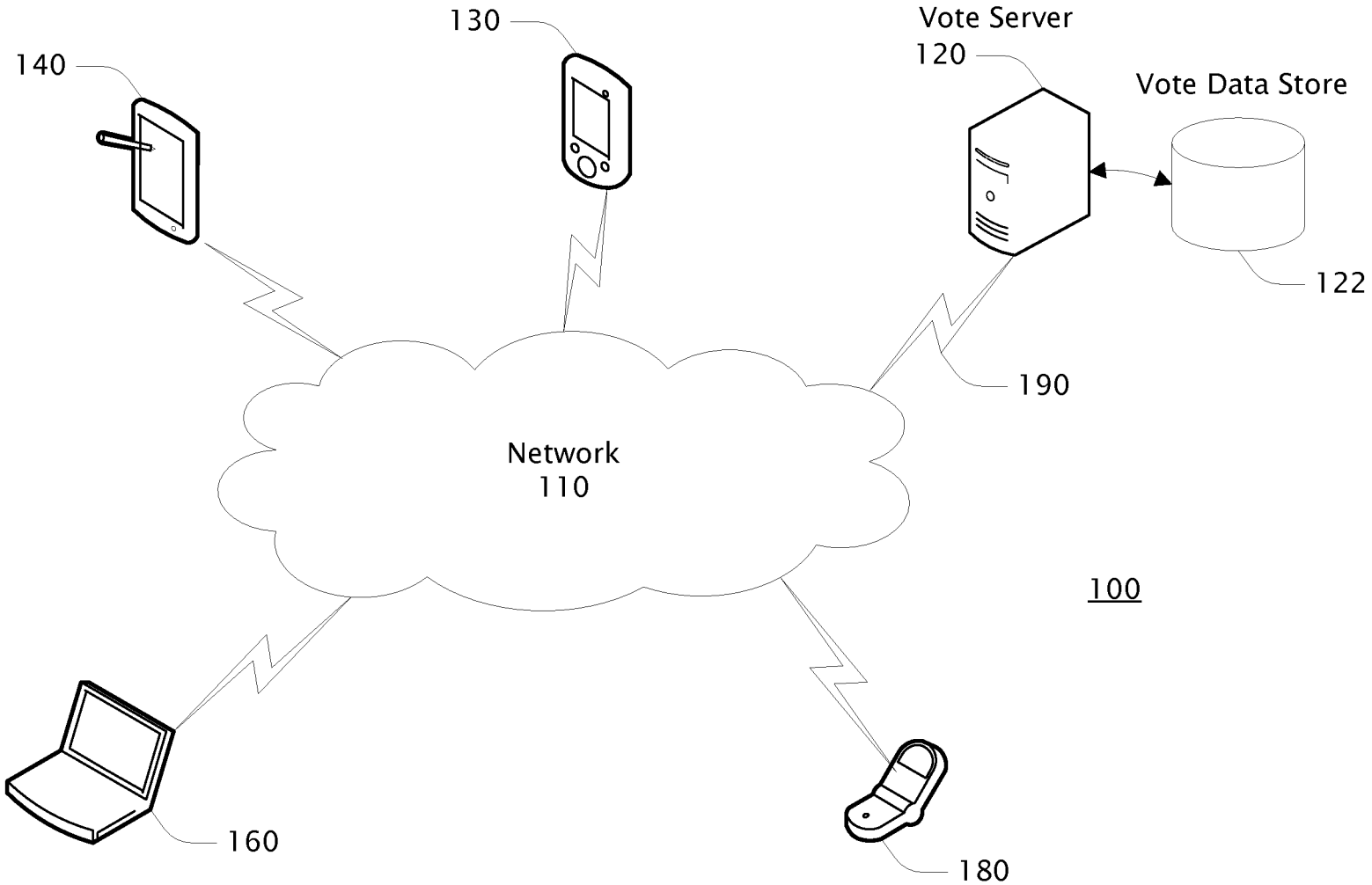
FIG. 1 is a block diagram showing example devices coupled to together via a network and to a vote server and vote data store.

FIG. 1 is a block diagram showing example devices coupled to together via a network 110 and to a vote server 120 and vote data store 122. Example devices include personal data assistant ("PDA") 130, tablet personal computer ("PC") 140, laptop PC 160, and cell phone 180. Some such devices may include computing environments such as that described in connection with FIG. 6. Such devices may include mobile devices or other devices such as desktop PCs, servers, or the like.

Devices may be coupled to network 110 via any operable link, such as example link 190. Such links may include a network interface card ("NIC"), a serial or parallel port, a data bus, an analog interface, or the like. Links may be wired or wireless, may make use of infrared ("IR"), acoustics, optics, radios frequency ("RF"), or the like. Network 110 may be an ad-hoc network with devices coupling transiently. Server devices, such as vote server 120, and other less mobile devices, may be coupled to network 110 more persistently than mobile devices. In one example, network 110 may be a wireless fidelity ("Wi-Fi") network at a coffee shop, city library, courtroom, or airport lounge. Mobile and other devices may typically link to such a Wi-Fi network via wireless adapters. Such devices may also be operable to link to other types of networks. In another example, cell phones may link to a cellular network via appropriate RF adapters and protocols. Such cell phones may also be operable to link to other types of networks, such as Wi-Fi networks or the like.

Network 110 may be a plurality of networks, each network providing connectivity for one or more devices. Such devices may be authenticated or the like to their respective networks and also be capable of forming a federation via their various networks. Thus a federation of devices is a grouping of two or more devices coupled together via one or more networks. Such devices may be grouped based on any criteria useful to the devices and/or users of the devices. Federated voting is the process of a federation of devices participating in a voting scenario.

Vote server 120 may host one or more voting applications with any persistent vote data typically being stored on vote data store 122. In one example, vote server 120 hosts a voting application allowing restaurant patrons to rate menu selections using wireless devices, and allowing newly arriving customers with wireless devices to view the rating.

Figure 2:
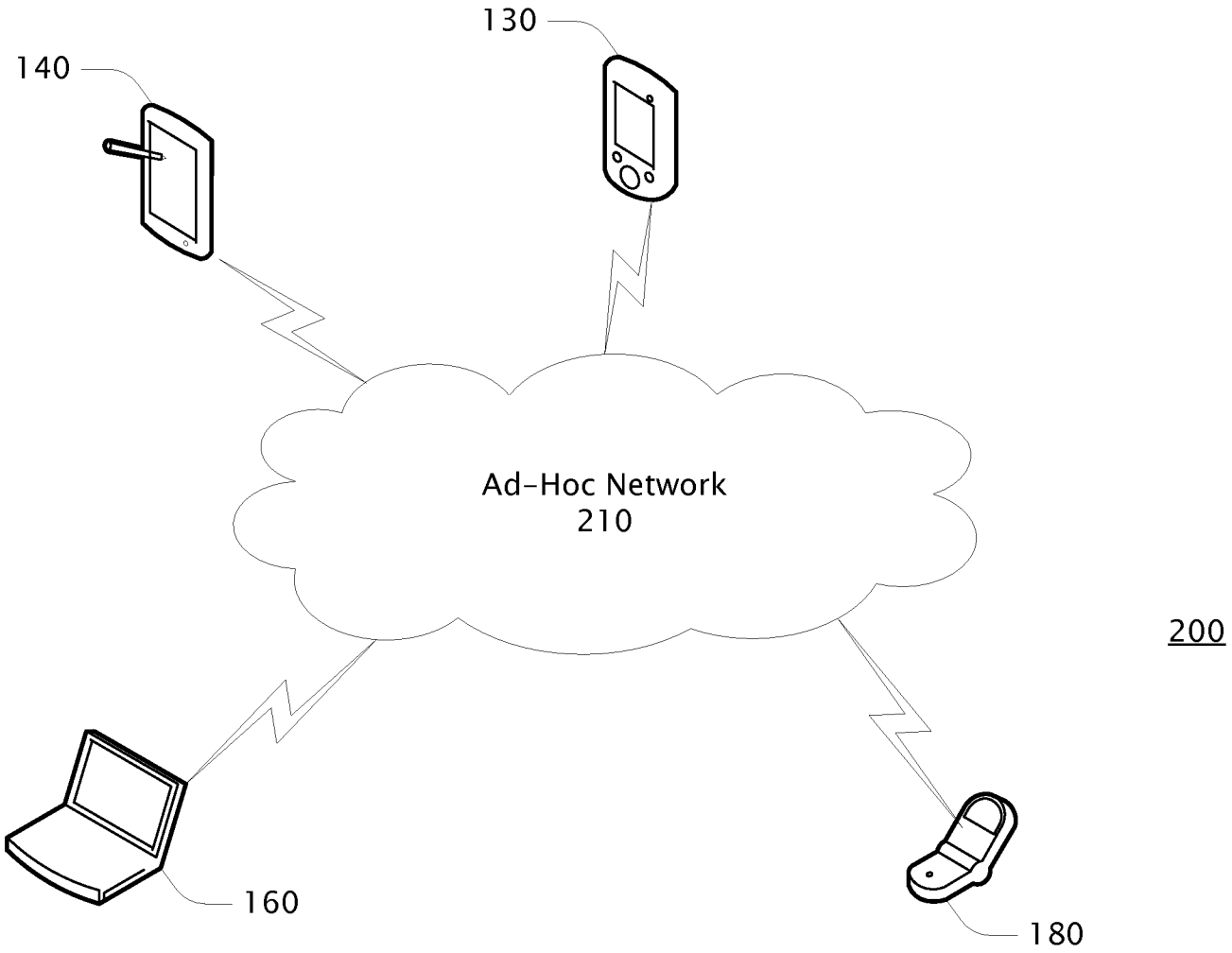
FIG. 2 is a block diagram showing example devices coupled to together via an ad-hoc network.

FIG. 2 is a block diagram showing example devices coupled to together via an ad-hoc network 210. Such an ad-hoc network may not include any persistent devices such as vote servers or related data stores. Ad-hoc networks for voting purposes may be formed as various devices, such as mobile devices, form and join such networks. For example, an ad-hoc network may be formed comprising devices of people on a particular bus. Example devices shown in FIG. 2 include those described in connection with FIG. 1.

Figure 3:
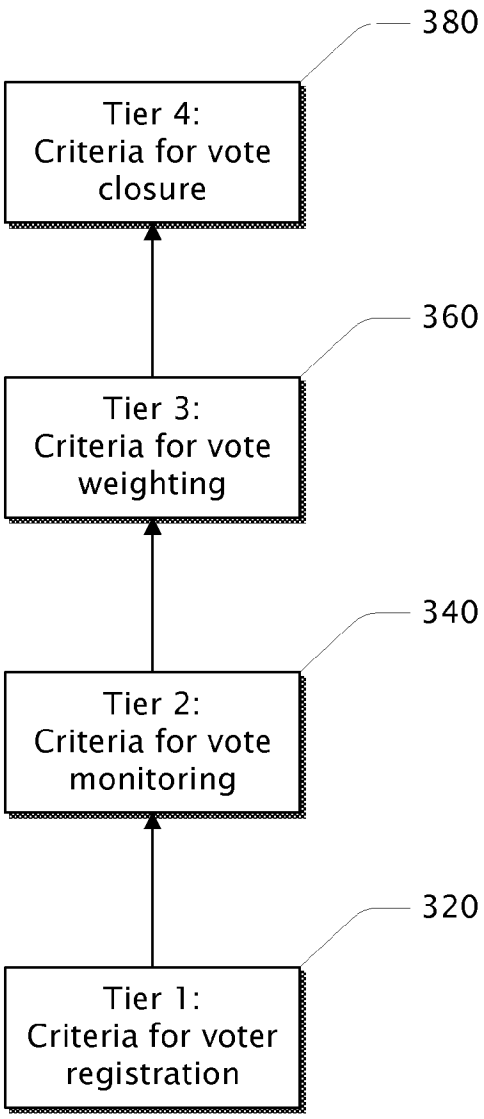
FIG. 3 is a block diagram showing example tiers of criteria-based discrimination for federated voting.

FIG. 3 is a block diagram showing example tiers of criteria-based discrimination for federated voting. One or more such tiers may be utilized by a criteria-based voting application. The criteria classes specified in each tier may be organized and/or grouped using alternative arrangements to those illustrated.

Block 320 indicates Tier 1 which typically specifies a class of criteria for discriminating between potential voters; that is determining whether a potential voter may register with a particular voting application to participate in a particular vote. In one example, registration criteria may include requirements for authenticating a potential voter, such authentication including validating credentials, completing a log-on process, or the like. For example, a potential voter may be allowed to vote on a company matter only if the voter is an authenticated employee of the company. In another example, registration criteria may discriminate based on the potential voter's identity or based on an association including membership, affiliation, or the like of the potential voter. For example, a potential voter may be allowed to vote on a union matter only if the voter is a member of the union. In yet another example, registration criteria may include any other characteristic including requirements, conditions, information, or the like. For example, a potential voter may be allowed to vote on the condition of a particular roadway only if currently in a car located on the road.

Block 340 indicates Tier 2 which typically specifies a class of criteria for discriminating between voters who are allowed to monitor voting; that is determining whether a particular voter is allowed to: monitor voting progress, access a vote weighting system, or the like. Monitoring voting progress may include: tracking the vote such in real-time, near real-time or the like. In one example, monitoring criteria may discriminate based on a voter's identity. For example, a voter may be allowed to monitor a party vote if the voter is a member of the party. In another example, monitoring criteria may discriminate based on an association, membership, affiliation, or the like of the voter. For example, a voter may be allowed to monitor the vote on a school matter only if the voter is a member of the school board. In yet another example, monitoring criteria may include any other requirement, condition, characteristic, information, or the like. For example, a voter may be allowed to monitor an on-going vote on the taste and quality of a various menu selections only if currently a patron of the restaurant. Alternatively or additionally, non-voters may be allowed to monitor voting; that is entities not participating in the vote and/or registered to vote.

Block 360 indicates Tier 3 which typically specifies a class of criteria for discriminating between voters who are allowed to vote; that is determining what weight is applied to the vote of a particular voter. Different votes may receive a different weight or the like such that some votes have more or less impact in the overall vote. In one example, vote weighting criteria may discriminate based on a voter's identity. For example, all patrons in a bar may be allowed to vote on the current channel of the bar's television, but the votes of "regulars" may carry twice the weight of those of other patrons. In another example, vote weighting criteria may discriminate based on an association, membership, affiliation, or the like of the voter. For example, the vote of a voter that will be directly impacted by a proposed sewer system may carry a greater weight than the votes of voters that would not be directly impacted. In yet another example, monitoring criteria may include any other requirement, condition, characteristic, information, or the like. For example, the vote of a voter with children, when considering a school bond issue, may carry a greater weight those without children.

Block 380 indicates Tier 4 which typically specifies a class of criteria for determining the closure of a vote; that is when the voting for a particular vote is completed. Such criteria may also be utilized to determine if and when a closed vote may be re-opened. In one example, vote closure criteria may discriminate based on a voter's identity. For example, once the creator of a vote casts his vote, the vote may be closed. In another example, closure criteria may include any other requirement, condition, characteristic, information, or the like. For example, a vote may be closed at a particular time, on a particular date, after a particular number of votes, based on a particular margin, or the like. In yet another example, a vote may be re-opened based on some criteria. For example, a registered voter in a closed vote may be allowed to invite another entity to vote, thus causing the vote to be re-opened for the newly invited voter. Alternatively or additionally, non-voters may be allowed to close voting; that is entities not participating in the vote and/or registered to vote.

The various classes of voting criteria may be combined to create novel voting scenarios. In one example, voters may make modifications or add alternatives to a vote, such as adding candidates, options, or the like. In one scenario, all voters in the vote may see such modifications in real-time. The ability to so modify a vote may include a cut-off period or a higher burden to add and/or modify as the vote nears an end, accumulates more votes, or the like. Voters may also be allowed to see queued-up pending changes that have yet to propagate through the voting system. Voters may also be allowed to change their vote, such as while seeing real-time vote results.

In another example, a vote's weighting system may change dynamically. For example, voters with kids in a school district may have higher vote weights, but if no one with kids votes then the weights may be changed dynamically to reflect the actual voting demographics. Also, voters with longer residency may have their vote weight dynamically changed resulting in a proportionally stronger vote.

In yet another example, a vote may be embodied in a form that includes an associated with the voter responsible for the vote. Many such votes may be collected on a device with the voter identity information associated with the votes. Such votes may be authenticated when collected on the device. Then the device may be carried into the range of a wireless voting system for the collected votes to be cast.

Figure 4:
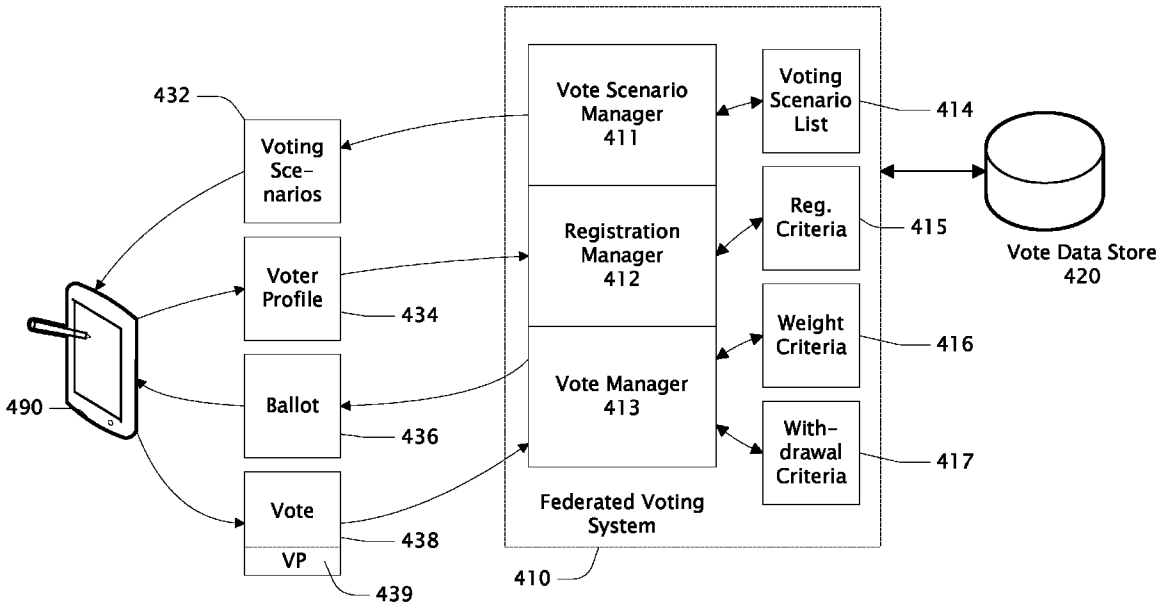
FIG. 4 is a block diagram showing an example federated voting system with discrimination criteria, along with an example vote data store, an example voting device, and example data structures used for voting operations.

FIG. 4 is a block diagram showing an example federated voting system 410 with discrimination criteria 414, 415, 416, and 417, along with an example vote data store 420, an example voting device 490, and example data structures 432, 434, 436, and 438 used for voting operations. Federated voting system 410 includes several example control modules including example voting scenario manager 411, example registration manager 412, and example vote manager 413. Such control modules may be implemented as device-, machine-, or computer-executable instructions recorded on storage media, as firmware, as hardware, as a combination of the foregoing, or the like. Such control modules may be combined in a single federated voting application residing on a single device, or may be distributed across several federated devices. Further, such control modules may be sub-divided into smaller functional parts or, alternatively may be combined in any appropriate manner. Vote data store 420 may be physically separate from federated voting system 410 or, alternatively, may be integrally combined with system 410, and may be any form of non-volatile storage media.

Example voting scenario manager 411 typically maintains a list of voting scenarios, or elections, that voters may register to participate in. Users of system 410 may be able to define new voting scenarios, edit existing voting scenarios, etc., via any appropriate interface, such as a user interface and/or application interface commonly used in the art. Such users may be persons, devices, systems, or the like. System 410 typically maintains a list 414 of defined voting scenarios. Such a list may include characteristics of the voting scenarios such as when the scenario becomes available, for how long, what users may see the scenario, edit the scenario, etc. Such a list may also include monitoring criteria for voting scenarios, such as what users can monitor voting progress in real-time, etc. Such a list may also include the criteria for closing the voting scenario, or an indication that the scenario may remain open indefinitely. Voting scenario list 414 may be stored in vote data store 420.

Example device 490 typically queries system 410 for a list of voting scenarios available to the user, to which system 410 responds with such a list 432. Such a query may be made via any appropriate interface, such as a user interface and/or application interface commonly used in the art. List 432 may include a subset of the information in voting scenario list 414. For example, list 432 provided to device 490 may include data structures, records, or the like, each record containing a title and description of a voting scenario and a unique voting scenario identifier ("VSID") or the like. The list 432 of voting scenarios typically serves to make the user aware of the voting scenarios available from system 410 for which the user may register.

Example registration manager 412 typically operates to receive a registration request from a device and perform a corresponding registration attempt. For example, device 490 provides a registration request including example voter profile 434 and a VSID identifying the voting scenario of interest. Registration manager 412 may discriminate based on registration criteria 415 to determine if the potential voter identified in the registration request may be registered for the voting scenario identified by the accompanying VSID. Registration manager 412 may discriminate based on information contained in voter profile 434 or, alternatively or additionally, seek for and make use of other information from other sources. For example, other information may include authentication information, credential validation information, or the like, and/or associations such as memberships, affiliations, or the like of the potential voter. A potential voter may be a person, device, system, or the like.

Should a potential voter identified by voter profile 434 meet registration criteria 415, then registration manager 412 typically registers the voter for the voting scenario identified by the accompanying VSID. Registration criteria 415 may be specific to the voting scenario identified by the VSID, may include aspects that apply to any or all voting scenarios on list 414, or both. Registration manager 412 may restrict registration based on voting scenario status, such as whether the voting scenario is closed. For example, should a potential voter wait to attempt to register until the voting scenario has closed then registration for the scenario may fail. Once a voter is registered for a particular voting scenario, registration manager 412 may register or record the "presence" of the voter in the voting scenario such that even if the voter never casts a vote it may be known that the voter was registered for the voting scenario and able to vote.

Example vote manager 413 typically provides example ballot 436 to device 590 for the registered voter, a person, device, system, or the like. Ballot 436 is typically a data structure or the like including a representation of the specific alternatives that may be voted upon for the registered voting scenario. Ballot 436 may include the VSID identifying the registered voting scenario and/or information from the voter profile identifying the ballot's target voter. Alternatively and/or additionally, ballot 436's associated VSID and/or target voter information may be identified via any appropriate mechanism. Vote manager 413 may restrict ballot delivery based on voting scenario status, such as whether the voting scenario is closed. For example, should a registered voter delay receipt of a ballot until after a voting scenario has closed then vote manager 413 may not provide ballot 436 to device 490.

Example vote manager 413 also typically accepts a vote from device 590, such as example vote 438. In addition to voter-selected ballot responses, vote 438 may include a voter profile 439 identifying the registered voter providing the vote. Voter profile 439 may also include a VSID identifying the voting scenario for which the vote is provided. Alternatively and/or additionally, vote 439's associated VSID and/or voter information may be identified via any appropriate mechanism. Vote manager 413 may restrict vote acceptance based on voting scenario status, such as whether the voting scenario is closed. For example, should a registered voter delay casting vote 438 until after a voting scenario has closed then vote manager 413 may not accept the vote.

Upon accepting a vote, vote manager 413 may discriminate based on weight criteria 416 to determine if a weighting is to be applied to the vote. Vote manager 413 may discriminate based on information contained in voter profile 439 or, alternatively or additionally, seek for and make use of other information from other sources in establishing a vote weight. For example, member voters in a club voting scenario may receive a full vote count while visitors may have their votes weighted at one-quarter a vote count such that it takes four visitor votes to equal one member vote.

In another scenario, example vote manager 413 may accept multiple votes on behalf of multiple registered voters from a single device. For example, several users may register to vote in a scenario and make their votes using any devices, and then collect the votes on a single device, such as device 490. Later, device 490 may connect to federated voting system 410, typically via a network, and provide the votes to system 410. For example, several members of a family may collect their votes on a single device with one of the family taking the device to an electronic polling place to submit the votes.

Example vote manager 413 may also allow users to withdraw previously cast votes. Provided a vote withdrawal request, vote manager 413 may discriminate based on withdrawal criteria 417 to determine if a vote withdrawal is allowed. Vote manager 413 may discriminate based on information contained in voter profile 439 or, alternatively or additionally, seek for and make use of other information from other sources in allowing a vote withdrawal. Vote manager 413 may restrict vote withdrawal based on voting scenario status, such as whether the voting scenario is closed. For example, should a registered voter request a vote withdrawal after a voting scenario has closed then vote manager 413 may not honor the withdrawal request.

Figure 5:
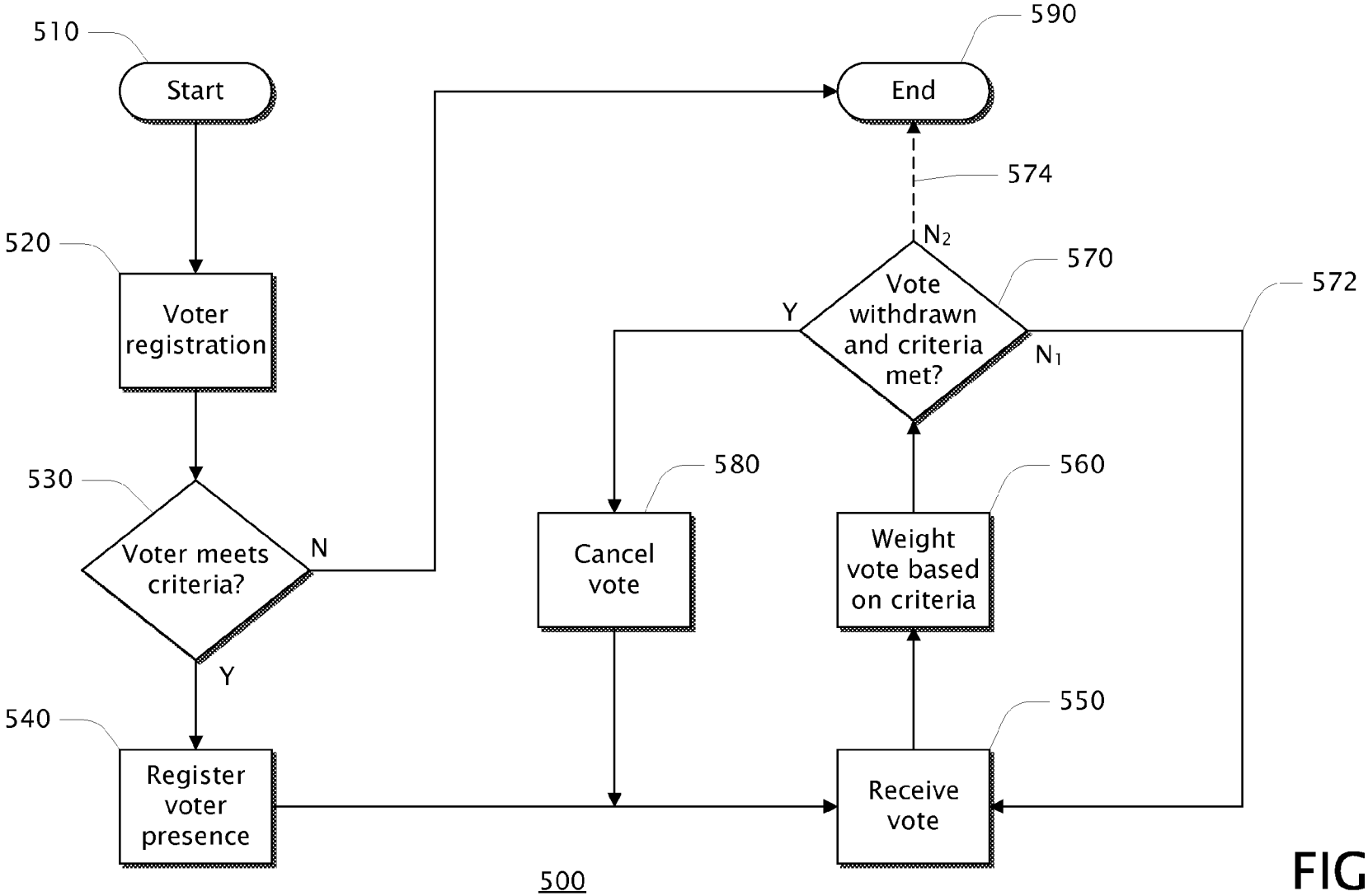
FIG. 5 is a block diagram showing an example federated voting process including criteria-based discrimination.

FIG. 5 is a block diagram showing an example federated voting process 500 including criteria-based discrimination. Process 500 typically begins as indicated by block 510 and continues until the voting is closed as indicated by block 590. Alternatively, voting may continue indefinitely in some scenarios, such as a voting scenario in which patrons vote on their favorite songs at a music shop. Various voting scenarios may include some or all of the steps show in process 500.

Block 520 indicates a voter registration step. In this step, potential voters are registered to vote in a particular voting scenario. Such registration may be a manual step, such as an individual explicitly "signing up" for a vote, or it may be automatic, such as a device coming into "range" of a voting service and automatically registering. For example, device users in vehicles in a particular traffic area are automatically registered to vote on traffic conditions in the area. In general, registration success may depend on a potential voter meeting specific registration criteria, as indicated by block 530.

Block 530 indicates a point of discrimination based on voter identity. In this step, potential voters may be evaluated based on some criteria. Based on the results of such an evaluation, a potential voter may or may not be allowed to participate in a particular vote. If a potential voter meets the criteria, then process 500 typically continues for the potential voter at block 540. If a potential voter does not meet the criteria, then the process typically ends for the potential voter at block 590. Generally other voters may continue to register and vote according to the specific voting scenario.

Block 540 indicates registering a voter's presence. In this step, the fact that a voter has successfully registered for the vote is noted by the voting system. Such information may be used to indicate that a voter was "present" for a vote, even if the voter did not actually cast a vote or cast a vote and later withdrew the vote. For example, a voter may be registered for a particular vote and monitor the vote progress in real-time. The voter may see that the vote is progressing in the desired direction and choose to not vote so as to not be on record for voting a particular way.

Block 550 indicates a voting system receiving a vote from a registered voter. In this step, a voter actually casts a vote which is received by the system. Typically this is done via a device, such as a mobile device. Such a vote is typically recorded by a voting system and may be stored in a vote data store, or maintained and processed by an ad-hoc voting structure. Votes may include profile information identifying the source of the vote, such a person's and/or device's identity. Alternatively, such a vote may be anonymous.

Block 560 indicates a point of discrimination for weighting a vote. In this step the vote is evaluated based on some criteria. Based on the results of such an evaluation, a vote may or may not be weighted differently than it would be otherwise. For example, in a family vote for which movie to watch, a parent's vote may be weighted more highly than a child's vote, the discrimination criteria being information identifying the parents from the children. Such identifying information is typically made available as part of a voter registration step.

Block 570 indicates the possible withdrawal of a previously received vote. In this step, if a vote is withdrawn and any withdrawal criteria are met, process 500 continues with block 580. If the vote is not withdrawn and if voting is closed, process 500 concludes as indicated by line 574 and block 590 (the $N_2$ path from block 570). Alternatively, if voting is not closed, process 500 typically continues accepting votes as indicated by line 572 (the $N_1$ path from block 570). A voting system may continue to accept registrations while voting is not closed. In one example, a vote may be withdrawn at any point after it is received by a voting system, at least up until voting is closed or withdrawals are no longer allowed. Alternatively, vote withdrawing may not be allowed at all, or only be allowed based on withdrawal criteria, in some voting scenarios.

Block 580 indicates canceling a withdrawn vote. In this step, a withdrawn vote is backed out of the voting system, typically impacting the vote tally as if the vote had never been cast.

Figure 6:
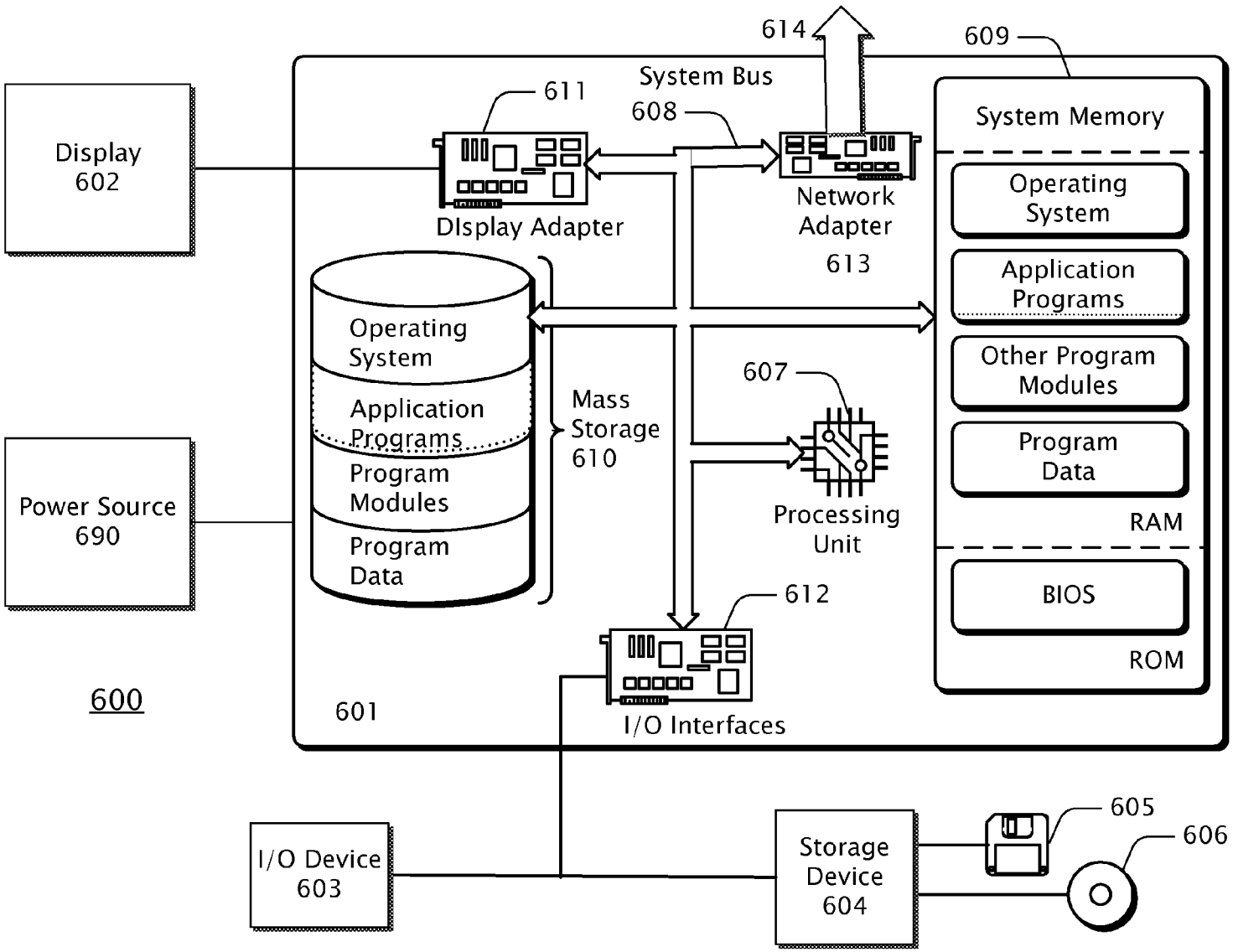
FIG. 6 is a block diagram showing an example computing environment in which the technologies described above may be implemented.

FIG. 6 is a block diagram showing an example computing environment 600 in which the technologies described above may be implemented. A suitable computing environment may be implemented with numerous general purpose or special purpose systems. Examples of well known systems may include, but are not limited to, cell phones, personal digital assistants ("PDA"), personal computers ("PC"), hand-held or laptop devices, microprocessor-based systems, multiprocessor systems, servers, workstations, consumer electronic devices, set-top boxes, and the like.

Computing environment 600 typically includes a general-purpose computing system in the form of a computing device 601 coupled to various components, such as peripheral devices 602, 603, 604 and the like. System 600 may couple to various other components, such as input devices 603, including voice recognition, touch pads, buttons, keyboards and/or pointing devices, such as a mouse or trackball, via one or more input/output ("I/O") interfaces 612. The components of computing device 601 may include one or more processors (including central processing units ("CPU"), graphics processing units ("GPU"), microprocessors ("μP"), and the like) 607, system memory 609, and a system bus 608 that typically couples the various components. Processor 607 typically processes or executes various computer-executable instructions to control the operation of computing device 601 and to communicate with other electronic and/or computing devices, systems or environment (not shown) via various communications connections such as a network connection 614 or the like. System bus 608 represents any number of several types of bus structures, including a memory bus or memory controller, a peripheral bus, a serial bus, an accelerated graphics port, a processor or local bus using any of a variety of bus architectures, and the like.

System memory 609 may include computer readable media in the form of volatile memory, such as random access memory ("RAM"), and/or non-volatile memory, such as read only memory ("ROM") or flash memory ("FLASH"). A basic input/output system ("BIOS") may be stored in non-volatile or the like. System memory 609 typically stores data, computer-executable instructions and/or program modules comprising computer-executable instructions that are immediately accessible to and/or presently operated on by one or more of the processors 607.

Mass storage devices 604 and 610 may be coupled to computing device 601 or incorporated into computing device 601 via coupling to the system bus. Such mass storage devices 604 and 610 may include non-volatile RAM, a magnetic disk drive which reads from and/or writes to a removable, non-volatile magnetic disk (e.g., a "floppy disk") 605, and/or an optical disk drive that reads from and/or writes to a non-volatile optical disk such as a CD ROM, DVD ROM 606. Alternatively, a mass storage device, such as hard disk 610, may include non-removable storage medium. Other mass storage devices may include memory cards, memory sticks, tape storage devices, and the like.

Any number of computer programs, files, data structures, and the like may be stored in mass storage 610, other storage devices 604, 605, 606 and system memory 609 (typically limited by available space) including, by way of example and not limitation, operating systems, application programs, data files, directory structures, computer-executable instructions, and the like.

Output components or devices, such as display device 602, may be coupled to computing device 601, typically via an interface such as a display adapter 611. Output device 602 may be a liquid crystal display ("LCD"). Other example output devices may include printers, audio outputs, voice outputs, cathode ray tube ("CRT") displays, tactile devices or other sensory output mechanisms, or the like. Output devices may enable computing device 601 to interact with human operators or other machines, systems, computing environments, or the like. A user may interface with computing environment 600 via any number of different I/O devices 603 such as a touch pad, buttons, keyboard, mouse, joystick, game pad, data port, and the like. These and other I/O devices may be coupled to processor 607 via I/O interfaces 612 which may be coupled to system bus 608, and/or may be coupled by other interfaces and bus structures, such as a parallel port, game port, universal serial bus ("USB"), fire wire, infrared ("IR") port, and the like.

Computing device 601 may operate in a networked environment via communications connections to one or more remote computing devices through one or more cellular networks, wireless networks, local area networks ("LAN"), wide area networks ("WAN"), storage area networks ("SAN"), the Internet, radio links, optical links and the like. Computing device 601 may be coupled to a network via network adapter 613 or the like, or, alternatively, via a modem, digital subscriber line ("DSL") link, integrated services digital network ("ISDN") link, Internet link, wireless link, or the like.

Communications connection 614, such as a network connection, typically provides a coupling to communications media, such as a network. Communications media typically provide computer-readable and computer-executable instructions, data structures, files, program modules and other data using a modulated data signal, such as a carrier wave or other transport mechanism. The term "modulated data signal" typically means a signal that has one or more of its characteristics set or changed in such a manner as to encode information in the signal. By way of example, and not limitation, communications media may include wired media, such as a wired network or direct-wired connection or the like, and wireless media, such as acoustic, radio frequency, infrared, or other wireless communications mechanisms.

Power source 690, such as a battery or a power supply, typically provides power for portions or all of computing environment 600. In the case of the computing environment 600 being a mobile device or portable device or the like, power source 690 may be a battery. Alternatively, in the case computing environment 600 is a computer or server or the like, power source 690 may be a power supply designed to connect to an alternating current ("AC") source, such as via a wall outlet.

Some mobile devices may not include many of the components described in connection with FIG. 6. For example, an electronic badge may be comprised of a coil of wire along with a simple processing unit 607 or the like, the coil configured to act as power source 690 when in proximity to a card reader device or the like. Such a coil may also be configure to act as an antenna coupled to the processing unit 607 or the like, the coil antenna capable of providing a form of communication between the electronic badge and the card reader device. Such communication may not involve networking, but may alternatively be general or special purpose communications via telemetry, point-to-point, RF, IR, audio, or other means. An electronic card may not include display 602, I/O device 603, or many of the other components described in connection with FIG. 6. Other mobile devices that may not include many of the components described in connection with FIG. 6, by way of example and not limitation, include electronic bracelets, electronic tags, implantable devices, and the like.

Those skilled in the art will realize that storage devices utilized to provide computer-readable and computer-executable instructions and data can be distributed over a network. For example, a remote computer or storage device may store computer-readable and computer-executable instructions in the form of software applications and data. A local computer may access the remote computer or storage device via the network and download part or all of a software application or data and may execute any computer-executable instructions. Alternatively, the local computer may download pieces of the software or data as needed, or distributively process the software by executing some of the instructions at the local computer and some at remote computers and/or devices.

Those skilled in the art will also realize that, by utilizing conventional techniques, all or portions of the software's computer-executable instructions may be carried out by a dedicated electronic circuit such as a digital signal processor ("DSP"), programmable logic array ("PLA"), discrete circuits, and the like. The term "electronic apparatus" may include computing devices or consumer electronic devices comprising any software, firmware or the like, or electronic devices or circuits comprising no software, firmware or the like.

The term "firmware" typically refers to executable instructions, code or data maintained in an electronic device such as a ROM. The term "software" generally refers to executable instructions, code, data, applications, programs, or the like maintained in or on any form of computer-readable media. The term "computer-readable media" typically refers to system memory, storage devices and their associated media, and the like.

In view of the many possible embodiments to which the principles of the present invention and the forgoing examples may be applied, it should be recognized that the examples described herein are meant to be illustrative only and should not be taken as limiting the scope of the present invention. Therefore, the invention as described herein contemplates all such embodiments as may come within the scope of the following claims and any equivalents thereto.

The invention claimed is:

1. A method performed on a mobile device of a federation of devices, the method comprising:

receiving registration criteria that are specific to a particular voting scenario, where the registration criteria comprise a list of voters of a plurality of voters, where the voters on the list are eligible for the particular voting scenario;

receiving a registration request for a voter on the list for the particular voting scenario;

determining, in response to the received registration request, that the voter meets the registration criteria;

registering the voter, based on the determining, for the particular voting scenario; and registering, in response to the registering the voter, a presence of the registered voter in the particular voting scenario, where the registered presence of the registered voter in the particular voting scenario indicates that the voter has been registered for the particular voting scenario regardless of whether or not the voter casts a vote in the particular voting scenario and regardless of whether or not the voter withdraws the cast vote in the particular voting scenario.

2. The method of claim 1 further comprising:
accepting a vote from the registered voter via the mobile device of the federation of devices;
weighting the vote based on weighting criteria; and
applying the weighted vote to the particular voting scenario.

3. The method of claim 2 further comprising:
receiving a request to withdraw the weighted vote; and
discriminating the request to withdraw the weighted vote based on withdrawal criteria, the request to withdraw succeeding based on the withdrawal criteria being met by the voter; and
canceling, based on the withdrawal criteria being met by the voter, the weighted vote from the particular voting scenario.

4. The method of claim 2 wherein the weighting criteria forms the weight-discriminated vote based at least in part on an identity of the registered user or an association of the registered user or a membership of the registered user or an affiliation of the registered user.

5. The method of claim 1 wherein the registration criteria is used to discriminate based on at least one of a voter identify, authentication, association, and characteristic.

6. The method of claim 1 embodied as device-executable instructions stored on at least one physical device-readable medium.

7. The method of claim 1 further comprising allowing the registered voter, based on monitoring criteria being met by the registered voter, to monitor voting in the particular voting scenario in substantially real-time, wherein to monitor voting includes allowing the registered voter to observe how the vote is progressing.

8. The method of claim 1 further comprising modifying, by the registered voter, the particular voting scenario by at least adding additional options to the particular voting scenario.

9. The method of claim 1 further comprising:
adding a new mobile device to the federation of devices, wherein the new mobile device includes a plurality of votes for the particular voting scenario, the plurality of votes collected on the new mobile device prior to the adding from a plurality of voters;
accepting the plurality of votes from the added new mobile device; and
applying each of the accepted plurality of votes to the particular voting scenario.

10. At least one physical computer-readable medium storing computer-executable instructions that, when executed by a mobile device of a federation of devices, cause the mobile device to perform actions comprising:
receiving registration criteria that are specific to a particular voting scenario, where the registration criteria comprise a list of voters of a plurality of voters, where the voters on the list are eligible for the particular voting scenario
receiving a registration request for a voter on the list for the particular voting scenario;
determining, in response to the received registration request, that the voter meets the registration criteria;
registering the voter, based on the determining, for the particular voting scenario;
registering, in response to the registering the voter, a presence of the registered voter in the particular voting scenario, where the presence of the registered voter in the particular voting scenario indicates that the voter has been registered for the particular voting scenario regardless of whether or not the voter casts does not cast a vote in the particular voting scenario and regardless of whether or not the voter withdraws the cast vote in the particular voting scenario.

11. The at least one physical computer-readable medium of claim 10, the actions further comprising:
accepting a vote from the registered voter via any device of the federation of devices;
weighting the vote based on weighting criteria; and
applying the weighted vote to the particular voting scenario.

12. The at least one physical computer-readable medium of claim 11, the actions further comprising:
receiving a request to withdraw the weighted vote; and
discriminating the request to withdraw the vote based on withdrawal criteria, the request to withdraw succeeding based on the withdrawal criteria being met by the voter; and
canceling, based on the withdrawal criteria being met by the voter, the weighted vote from the particular voting scenario.

13. The at least one physical computer-readable medium of claim 10, the actions further comprising:
adding a new mobile device to the federation of devices, wherein the new mobile device includes a plurality of votes for the particular voting scenario, the plurality of votes collected on the new mobile device prior to the adding from a plurality of voters;
accepting the plurality of votes from the added new mobile device; and
applying each of the accepted plurality of votes to the particular voting scenario.

14. A mobile device and at least one program module that are together configured for performing actions comprising:
receiving registration criteria that are specific to a particular voting scenario, where the registration criteria comprises a list of voters of a plurality of voters, where the voters on the list are eligible for the particular voting scenario
receiving a registration request for a voter on the list for the particular voting scenario;
determining, in response to the received registration request, that the voter meets the registration criteria;
registering the voter, based on the determining, for the particular voting scenario;
registering, in response to the registering the voter, a presence of the registered voter in the particular voting scenario, where the registered presence of the registered voter in the particular voting scenario indicates that the voter has been registered for the particular voting scenario regardless of whether or not the voter casts a vote in the particular voting scenario and regardless of whether or not the voter withdraws the cast vote in the particular voting scenario.

15. The mobile device and the at least one program module of claim 14, the actions further comprising:
accepting a vote from the registered voter via the mobile device of the federation of devices;
weighting the vote based on weighting criteria; and
applying the weighted vote to the particular voting scenario.

16. The mobile device and the at least one program module of claim 15, the actions further comprising:
receiving a request to withdraw the weighted vote; and
discriminating the request to withdraw the weighted vote based on withdrawal criteria, the request to withdraw succeeding based on the withdrawal criteria being met by the voter; and canceling, based on the withdrawal criteria being met by the voter, the weighted vote from the particular voting scenario.

17. The mobile device and the at least one program module of claim 14 where the registration criteria is used to discriminate based on at least one of a voter identify, authentication, association, and characteristic.

18. The mobile device and the at least one program module of claim 14, the actions further comprising allowing the registered voter, based on monitoring criteria being met by the registered voter, to monitor voting in the particular voting scenario in substantially real-time, wherein to monitor voting includes allowing the registered voter to observe how the vote is progressing.

19. The mobile device and the at least one program module of claim 14, the actions further comprising modifying, by the registered voter, the particular voting scenario by at least adding additional options to the particular voting scenario.

20. The mobile device and the at least one program module of claim 14, the actions further comprising:

adding a new mobile device to the federation of devices, wherein the new mobile device includes a plurality of votes for the particular voting scenario, the plurality of votes collected on the new mobile device prior to the adding from a plurality of voters;

accepting the plurality of votes from the added new mobile device; and applying each of the accepted plurality of votes to the particular voting scenario.

* * * * *